United States Patent [19]

Hammett

[11] Patent Number: 4,789,063

[45] Date of Patent: Dec. 6, 1988

[54] SPACER TRAY FOR PACKAGING CONTAINERS

[75] Inventor: Roy Hammett, Tampa, Fla.

[73] Assignee: International Container Systems, Inc., Tampa, Fla.

[21] Appl. No.: 16,310

[22] Filed: Feb. 19, 1987

Related U.S. Application Data

[63] Continuation-in-part of Ser. No. 925,755, Oct. 30, 1986, abandoned, which is a continuation-in-part of Ser. No. 904,725, Sep. 8, 1986, abandoned.

[51] Int. Cl.[4] ..... B65D 71/08

[52] U.S. Cl. ..... 206/432; 206/139; 206/45.33; 206/497; 206/515

[58] Field of Search ..... 206/139, 45.33, 432, 206/497, 515; 229/2.5 R, DIG. 12

[56] References Cited

U.S. PATENT DOCUMENTS

| | | | |
|---|---|---|---|
| Re. 27,212 | 11/1971 | Brown . | |
| D. 152,683 | 2/1949 | Erickson | D58/13 |
| D. 197,356 | 1/1964 | De Shazor, Jr. . | |
| D. 197,357 | 1/1964 | De Shazor, Jr. . | |
| D. 197,358 | 1/1964 | De Shazor, Jr. . | |
| 2,215,252 | 9/1940 | Randall et al. | 217/26 |
| 2,314,198 | 3/1943 | De Reamer . | |
| 2,352,684 | 7/1944 | Braddock | 65/15 |
| 2,565,299 | 8/1951 | Erickson | 220/21 |
| 2,614,399 | 10/1952 | Roethel | 62/108.5 |
| 2,776,772 | 1/1957 | Itoda | 217/26.5 |
| 2,965,226 | 12/1960 | Ettlinger, Jr. . | |
| 2,989,175 | 6/1961 | Jekel . | |
| 3,134,485 | 5/1964 | Bonkowski et al. . | |
| 3,151,762 | 10/1964 | Vidal | 220/21 |
| 3,155,268 | 11/1964 | Fogerty et al. | 220/21 |
| 3,171,562 | 3/1965 | Weiss | 217/26.5 |
| 3,199,908 | 8/1965 | Poupitch | 294/87.2 |
| 3,206,020 | 9/1965 | Billingsley et al. . | |
| 3,224,575 | 12/1965 | Whiteford . | |
| 3,224,576 | 12/1965 | Whiteford . | |
| 3,242,631 | 3/1966 | Whiteford | 53/35 |
| 3,258,288 | 6/1966 | Courter | 294/87.2 |
| 3,261,531 | 7/1966 | Barth | 229/2.5 |
| 3,338,406 | 8/1967 | Anderson . | |
| 3,346,106 | 10/1967 | Gooding . | |
| 3,351,264 | 11/1967 | Bostrom | 229/42 |
| 3,353,326 | 11/1967 | Becker | 53/24 |
| 3,385,429 | 5/1968 | Becker et al. . | |
| 3,416,695 | 12/1968 | Bessett et al. | 220/23.8 |

(List continued on next page.)

FOREIGN PATENT DOCUMENTS

| | | | |
|---|---|---|---|
| 77479 | 4/1954 | Denmark . | |
| 1274380 | 9/1961 | France . | |
| 1447702 | 6/1966 | France | 220/21 |
| 1007869 | 4/1969 | Japan | 206/432 |
| 4410078 | 4/1969 | Japan | 206/432 |
| 7512618 | 5/1976 | Netherlands | 206/497 |
| 742959 | 1/1956 | United Kingdom . | |
| 1197058 | 7/1970 | United Kingdom . | |
| 1490627 | 11/1977 | United Kingdom . | |

*Primary Examiner*—William Price

*Attorney, Agent, or Firm*—Pennie & Edmonds

[57] ABSTRACT

A spacer tray 2 for containers 32 is formed of a plastic sheet material and is shaped to provide a plurality of container-bottom receptacles 4. Each container-bottom receptacle 4 is shaped to receive at least a part of a bottom portion of a container 32. A container spacer wall 30 is located between each pair of adjacent container-bottom receptacles 4 to maintain bottom portions of containers seated in the receptacles spaced apart from one another. The spacer tray 2 can include nesting-binding interference structures 40, 42 to prevent two spacer trays placed one atop the other from binding when one tray is rotated 180 degrees relative to but otherwise aligned with the other tray. The spacer tray can include a plurality of container-loading-guide-pin openings 36 passing through it which permit container-loading guide pins 78—from a high-speed spacer-tray loading machine, for example—to pass through for locating the spacer tray 2 and guiding bottom portions of containers 32 into container-bottom receptacles 4 during loading of the spacer tray.

18 Claims, 8 Drawing Sheets

U.S. PATENT DOCUMENTS

| | | | |
|---|---|---|---|
| 3,497,102 | 2/1970 | Bessett et al. | 220/23.8 |
| 3,509,993 | 5/1970 | Michel . | |
| 3,592,350 | 7/1971 | Martelli et al. | 217/19 |
| 3,627,121 | 12/1971 | Deasy . | |
| 3,628,659 | 12/1971 | Mitchell | 209/126 |
| 3,650,395 | 3/1972 | Hobbs . | |
| 3,664,497 | 5/1972 | Mascia . | |
| 3,667,647 | 6/1972 | Van Daalen | 220/23.4 |
| 3,675,767 | 7/1972 | Taylor . | |
| 3,724,654 | 4/1973 | Gerard et al. . | |
| 3,756,429 | 9/1973 | Fleischer et al. | 214/10.5 R |
| 3,791,549 | 2/1974 | Delbrouck et al. | 220/21 |
| 3,799,143 | 3/1974 | Bridges | 126/246 |
| 3,799,333 | 3/1974 | Weir et al. | 206/482 |
| 3,850,296 | 11/1974 | Hirata et al. | 206/334 |
| 3,949,876 | 4/1976 | Bridges et al. | 206/427 |
| 3,962,469 | 6/1976 | Leavens et al. | 426/108 |
| 4,012,530 | 3/1977 | Holden | 426/124 |
| 4,120,396 | 10/1978 | Mascia et al. | 206/151 |
| 4,142,634 | 3/1979 | Leff et al. | 206/392 |
| 4,170,294 | 10/1979 | Zelinski | 206/45.33 |
| 4,194,678 | 3/1980 | Jasper | 229/23 R |
| 4,286,715 | 9/1981 | Martelli et al. | 206/564 |
| 4,289,236 | 9/1981 | Ganz et al. | 206/432 |
| 4,487,312 | 12/1984 | Heider | 206/158 |
| 4,516,677 | 5/1985 | Rowland et al. | 206/394 |
| 4,518,081 | 5/1985 | De Larosiere | 206/158 |
| 4,567,981 | 2/1986 | Headon | 206/45.14 |

SPACER TRAY FOR PACKAGING CONTAINERS

RELATED APPLICATION

This application is a continuation-in-part of application Ser. No. 925,755, filed Oct. 30, 1986, which in turn is a continuation-in-part of application Ser. No. 904,725, filed Sept. 8, 1986 now abandoned.

TECHNICAL FIELD

The present invention relates to packaging of containers such as cans of beverage for storage and transport.

BACKGROUND ART

Beverages such as beer and soft drinks are frequently packaged in cans which are marketed to consumers in groups termed "multipacks." Groups of six, eight or twelve cans, termed "six packs," "eight packs" and "twelve packs" respectively, are widely used for retail sales, with the six pack being the most popular. Six packs are typically shipped from the producer to the retailer in open-topped, low-sided corrugated cardboard cartons, four six-packs to a carton. The carton of six packs is often wrapped with a plastic shrink wrap to hold the six packs in place.

The six cans of a six pack are typically held together to form a rectangular two-row by three-column array with a flexible plastic holder termed a "top grip" which has loops into which the tops of the cans fit. The top grip generally maintains a separation of a few millimeters or so between the top portions of adjacent cans in the six pack.

Although the top grip generally maintains a separation between the top portions of adjacent cans in a six pack, the flexibility of the top grip permits adjacent cans to touch near the bottom of the cans. Touching of adjacent cans gives rise to serious problems in the shipment of six packs of cans. Motion during shipment often causes adjacent cans which are touching to rub one another at the points of contact. Such rubbing can wear away the graphics or labelling on the can. The resulting worn spots on the cans are unsightly and reduce the appeal of the product to potential customers. Moreover, adjacent cans which touch can rub one another to such an extent during shipment that a wall of one of the cans wears completely through. When the wall of a can wears through, liquid in the can leaks out. Even a single can which leaks in a shipment of cans of beverage represents a serious loss, since health codes frequently require that an entire shipment be scrapped if a single can leaks.

A further disadvantage of corrugated cardboard cartons for shipping six packs of cans is that moisture—from condensation, leakage, or other source—tends to weaken the carton. In humid climates, moisture from condensation can weaken a corrugated cardboard carton to such an extent that the carton cannot bear the weight of the cans being transported in the carton.

U.S. Pat. No. 3,650,395 to Hobbs discloses a tray formed with a number of depressions for locating the ends of containers such as cans or bottles. The tray is imperforate and is vacuum-formed from a thin sheet of synthetic plastic material. The edge of the tray has a continuous upstanding peripheral flange having at its upper edge an outwardly-projecting lip. To form a package, containers are placed in the tray with the bottom ends of the containers placed in the depressions of the tray. A film of synthetic plastic wrapping material is wrapped around the containers and the tray and heat shrunk to hold the containers and the tray together.

The tray of the '395 patent has a number of drawbacks, particularly with respect to its use in a high-speed commercial canning or bottling operation. For example, if a number of the trays are stacked one atop the other, adjacent trays tend to nest together and bind. Such binding tends to give rise to troublesome problems when stacks of trays are used to feed a high-speed can or bottle packaging machine. Moreover, in warehousing cartons of cans or bottles, warehouse operators frequently stack the cartons in multilayered structures in which—for stability—adjacent layers of cartons are oriented perpendicular to one another. The arrangement of such multilayered structures is called cross-stacking. The outwardly-projecting lip of the peripheral flange of the tray of the '395 patent tends to interfere with cross-stacking shrink-wrapped packages of cans or bottles in the trays. In addition, canning and bottling operations are frequently high-volume, low-profit-margin businesses for which packaging costs represent a significant expense. Any reduction in the cost of a tray used in packaging cans or bottles would therefore be desirable.

U.S. Pat. No. 4,194,678 to Jasper discloses a shipping carton for bottles of medical liquids such as intravenous solutions. The carton is evidently made of corrugated cardboard and includes a reinforcing panel to form a rigid crush-resistant structure. A pocketed insert formed to accommodate the shape of the bases of the bottles is held in the bottom of the carton by the reinforcing panel. The pocketed insert can be a vacuum formed sheet with pockets which accommodate half or quarter portions of the bases of the bottles. The rigid shipping carton of the '678 patent is evidently subject to the drawbacks of corrugated cardboard containers noted above. Moreover, the shipping carton is unduly bulky and expensive for shipping beverages or other canned or bottled retail goods.

DISCLOSURE OF THE INVENTION

I have invented an economical spacer tray for cans, bottles, or other containers which is suitable for use with high-speed packaging equipment and which avoids problems of the prior art noted above.

The spacer tray of the invention is formed of a plastic sheet material. The spacer tray is shaped to provide a plurality container-bottom receptacles. The container-bottom receptacles are disposed in a row-column array, such as a four-row by six-column array. Each container-bottom receptacle is shaped to receive at least a part of a bottom portion of a container. A container spacer wall is located between each pair of adjacent container-bottom receptacles to maintain the bottom portions of containers seated in a pair of adjacent container-bottom receptacles spaced apart from one another.

The spacer tray of the invention preferably includes a plurality of nesting-binding interference structures. The nesting-binding interference structures are shaped and positioned to prevent a first and a second spacer tray facing in the same direction which are placed one atop the other from binding when the container-bottom receptacles of the two spacer trays are substantially coaxially aligned.

In a preferred embodiment, the nesting-binding interference structures are shaped and positioned to prevent two spacer trays from binding which are placed one atop the other facing in the same direction with container-bottom receptacles substantially aligned and with one spacer tray rotated substantially 180 degrees relative to the other in the plane of the spacer trays. Thus, a stack of such spacer trays can be formed - for feeding a high-speed spacer-tray loading machine, for example—with the container-bottom receptacles of the spacer trays aligned and with alternate spacer trays in the stack rotated 180 degrees relative to the other spacer trays in which the spacer trays in the stack do not nest together so tightly as to bind.

In an alternative preferred embodiment, the nesting-binding interference structures are shaped and positioned to prevent two spacer trays from binding which are placed one atop the other facing in the same direction with container-bottom receptacles substantially aligned and either with one spacer tray rotated substantially 180 degrees relative to the other in the plane of the spacer trays or with the two spacer trays not rotated relative to each other in the plane of the spacer trays. A stack of such spacer trays can be formed with the container-bottom receptacles of the spacer trays aligned in which the spacer trays in the stack do not nest together so tightly as to bind independently of whether or not adjacent spacer trays have been rotated 180 degrees relative to one another in the plane of the spacer trays.

Preferably, the container-bottom receptacles are disposed in a row-column array with a number of columns greater than two and a number of rows greater than two. The container-bottom receptacles located on the perimeter of the spacer tray define tray-periphery container-bottom receptacles. If the number of columns of container-bottom receptacles is designated m and the number of rows is designated n, the total number of container-bottom receptacles equals $(m \times n)$ and the number of tray-periphery container-bottom receptacles equals $2(m+n)-4$. Each tray-periphery container-bottom receptacle may be configured to surround only partially the bottom portion of a container seated in the receptacle, so that a part of the container extends outwardly of the perimeter of the spacer tray. Consequently, the lateral dimensions of an array of containers seated in such a preferred spacer tray exceeds the lateral dimensions of the spacer tray itself.

The spacer tray of the invention preferably has a plurality of container-loading-guide-pin openings passing through it. Each container-loading-guide-pin opening is preferably located centrally of four container-bottom receptacles whose locations are defined by the intersection of a pair adjacent rows of receptacles with a pair of adjacent columns of receptacles. If the number of columns of container-bottom receptacles is designated m and the number of rows is designated n, the number of such container-loading-guide-pin openings is preferably $(m-1)\times(n-1)$. Each container-loading-guide-pin opening is shaped to permit a container-loading guide pin—from a high-speed spacer tray loading machine, for example—to pass through the opening for locating the spacer tray and guiding bottom portions of containers into the container-bottom receptacles during loading of the spacer tray by the loading machine.

The container-bottom receptacles of the spacer tray of the invention can be shaped to accommodate cans, bottles or other containers. The spacer tray is particularly adapted for accommodating multipacks of containers such as six packs, eight packs or twelve packs, although the spacer tray of the invention can also be used to advantage to accommodate unconnected containers. The containers may contain beverages, food stuffs, petroleum products or other goods.

A particularly preferred spacer tray of the invention has twenty-four container-bottom receptacles shaped and positioned to locate the bottom portions of twenty-four cans in an array of four rows by six columns. For certain applications, it may be preferred for the spacer tray to have twelve container-bottom receptacles shaped and positioned accommodate twelve cans in an array of three rows by four columns. Other numbers and arrangements of container-bottom receptacles may be used if desired.

To form a container-transport package of containers for storage and shipment, the containers are placed in a spacer tray of the invention and the tray with the containers seated in it is enclosed with heat-shrinkable plastic film which is then caused to shrink by heating. The resulting taut shrink-wrap covering holds the containers in the spacer tray. The spacer tray in turn maintains a suitable clearance—such as a few millimeters, for example—between the lower portions of containers held in the tray to prevent rubbing of adjacent containers during transport. The spacer tray also contributes to the rigidity of the container-transport package.

Preferred spacer trays of the invention are particularly adapted for use with conventional six packs of cans held together with a top grip. Particularly preferred spacer trays can accommodate four such six packs. Typically, the top grip of the six pack maintains a separation between the top portions of adjacent cans in the six pack and in many cases also between the top portions of cans of the six pack and the top portions of cans of adjacent six packs. If the top grips do not maintain a separation between the top portions of cans in a six pack and the top portions of cans in adjacent six packs, it may for some applications be advantageous to place cardboard spacer strips between adjacent six packs. The spacer tray of the invention maintains a separation between the bottom portions of the cans of the four sixpacks. The shrink-wrap covering protects the cans on the outer perimeter of the package from rubbing and wear by the cans of adjacent packages or by other surfaces.

The spacer tray of the invention can also be used for shipping loose containers; i.e., containers which are not connected by top grips to form multipacks. In one preferred embodiment for use with loose cans, each can-bottom receptacle on the perimeter of the spacer tray extends substantially entirely around the bottom portion of a can seated in the receptacle in order to hold the can in position laterally during the packaging operation. A first spacer tray can be used to locate and maintain spacing between the bottom portions of the cans and a second, inverted tray can be used to locate and maintain spacing between the top portions of the cans. The cans and the two trays can be wrapped with a taut shrink-wrap covering to form a can-transport package for shipment and storage.

Two spacer trays—a first spacer tray on the bottom and a second, inverted spacer tray on the top—can also be used in packaging multipacks of containers, if desired. A second spacer tray for the tops of containers in multipacks is preferred if the top grips of the multipacks do not adequately maintain a spacing between top portions of adjacent containers.

Preferably, the spacer tray of the invention is dimensioned so that the outer perimeter of the spacer tray extends no further laterally than the outer edges of the containers seated in the spacer tray around the perimeter of the spacer tray. Container-transport packages using such preferred spacer trays can be formed to advantage into stable multilayered cross-stacked structures with the undersides of the container-bottom receptacles of spacer trays in the upper layers substantially coaxially aligned with the tops of the containers in the layers immediately below.

A preferred embodiment of the spacer tray of the invention which is particularly adapted for shipping loose containers having indentations formed in the bottoms of the containers includes container-bottom locators disposed centrally within at least certain of the container-bottom receptacles of the spacer tray. The container-bottom locators of such preferred spacer trays are shaped to fit within the indentations of the bottoms of the containers to tend to locate the container and hold it in position laterally. Conventional cans for beverages, for example, generally have a concave indentation formed centrally in the bottom of the cans. For locating such cans, the container-bottom locators are preferably shaped to form dome-shaped bosses which fit within the concave indentations.

Most preferably, only each of the four corner container-bottom receptacles of such a preferred spacer tray includes a container-bottom locator. To hold a container in position laterally, walls of such a corner container-bottom receptacle facing radially-outer walls of a bottom portion of the container seated in the receptacle need not extend substantially entirely, around the bottom portion of the can, since the container-bottom locator which fits within the indentation of the bottom of the container tends to hold the container in position laterally. The outer perimeters of the corners of such a preferred spacer tray need not extend laterally further than the outer edges of the containers seated in the four corner container-bottom receptacles of the spacer tray. Each container-bottom receptacle other than the corner receptacles of such a preferred spacer tray can have walls which extend around the radially-outer walls of the bottom portion of a container seated in the receptacle to an extent sufficient to tend to locate and hold the container in position laterally without the outer perimeter of the spacer tray extending laterally beyond the outer edges of containers seated in the spacer tray. The container-bottom receptacles other than the corner receptacles can therefore advantageously have openings passing centrally through them to reduce weight and material costs of the spacer tray.

A can widely used in the beverage industry has an annular can base lip at the bottom of the can and an annular can top lip at top of the can. The can-base-lip and the can top lip are respectively dimensioned so that when one such can is placed upon another in coaxial alignment, the base lip of the upper can fits within the top lip of the lower can. The container-bottom receptacles of spacer trays of the invention adapted for use with such cans preferably have an annular can-base-lip groove formed in the bottom which is dimensioned to receive the annular can-base-lip of a first can seated in the receptacle and to fit within the top lip of a second can when the receptacle is placed upon the top of the second can. Preferred spacer trays with such can-base-lip grooves can be used to form shrink-wrap covered can transport packages of cans which interlock when stacked one upon the other by means of the can-base-lip grooves of the container-bottom receptacles of the spacer trays of the upper can-transport packages fitting within the annular top lips of the cans in the can-transport packages immediately below. The shrink-wrap covering of the can-transport packages deforms to permit the interlocking to occur. Multilayered cross-stacked structures of can-transport packages which are so interlocked are extremely stable, which is a significant advantage in warehousing and shipping such can-transport packages.

The spacer tray of the invention can be manufactured inexpensively from a single sheet of a plastic sheet material by a thermoforming or vacuum forming process. The spacer tray preferably includes cutout areas centrally of the container-bottom receptacles to reduce the weight of the tray and consequently the cost of the materials of which the tray is made. Polystyrene is a preferred plastic sheet material for manufacturing the spacer tray. A particularly preferred material out of which to make the spacer tray of the invention is reprocessed polyethylene terephthalate (PET) plastic. A source of PET plastic for reprocessing are PET soft-drink bottles returned to soft-drink bottlers in states having bottle-return laws. Disposal of returned PET soft-drink bottles is a significant problem for soft-drink bottlers in such states.

The spacer tray of the invention can be used in packaging the canned or bottled goods produced by a high-speed canning or bottling operation in sturdy, moisture-proof container-transport packages. The shrink-wrap covering of the container-transport packages can be essentially transparent, so that the container in the package can be readily identified visually. Moreover, the container-transport packages are inexpensive and the spacer tray and shrink-wrap covering of the packages can be disposed of easily after a single use.

BRIEF DESCRIPTION OF THE DRAWINGS

Preferred embodiments of the invention are described below with reference to the following drawings.

BEST MODE FOR CARRYING OUT THE INVENTION

Figure 1:
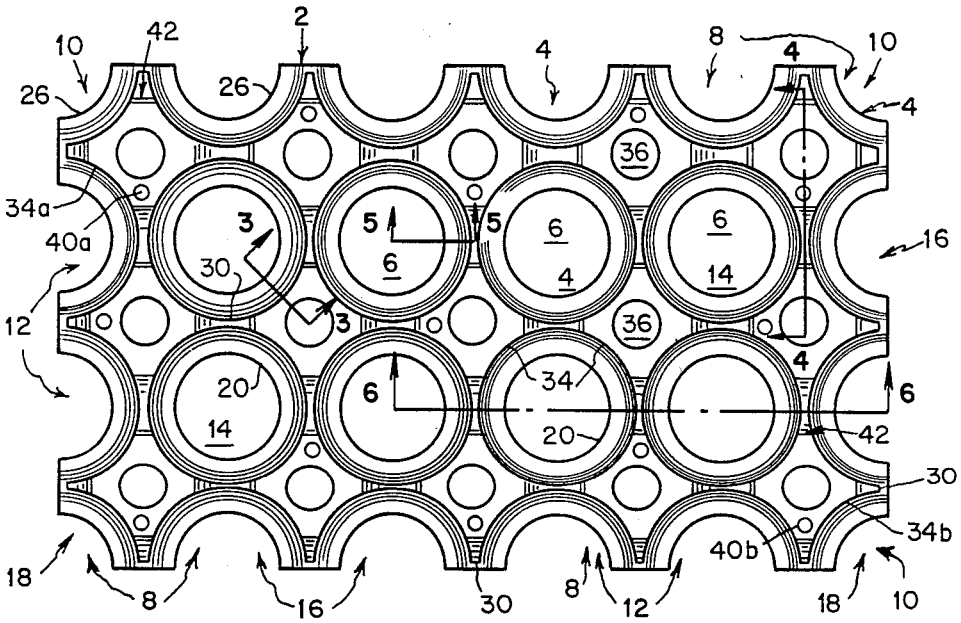
FIG. 1 is a top view of a preferred spacer tray of the invention for accommodating four six-packs of cans.

Referring now to FIG. 1, a spacer tray 2 is formed from a single sheet of a plastic sheet material. The spacer tray 2 is shaped to form twenty-four can-bottom receptacles 4. The can-bottom receptacles 4 are arranged in four essentially parallel columns and six essentially parallel rows, the rows and columns extending generally perpendicular to one another. The distance between adjacent rows substantially equals the distance between adjacent columns, so that the can-bottom receptacles 4 are arranged on an essentially square lattice. Eight of the can-bottom receptacles 4 are located interior of the spacer tray 2 and define tray-interior can-bottom receptacles 6. Sixteen of the can-bottom receptacles 4 are located around the perimeter of the spacer tray 2 and define tray-periphery can-bottom receptacles 8. The tray periphery can-bottom receptacles include four corner can-bottom receptacles 10 and twelve interior-edge can-bottom receptacles 12.

Each can-bottom receptacle 4 is shaped to receive at least a part of the bottom portion of a can: each tray interior can-bottom receptacle 6 is shaped to receive essentially the entire bottom portion of a can, each interior-edge can-bottom receptacle 12 is shaped to receive a generally half-section bottom portion of a can, and each corner can-bottom receptacle 10 is shaped to receive a generally quarter-section bottom portion of a can.

Figure 2:
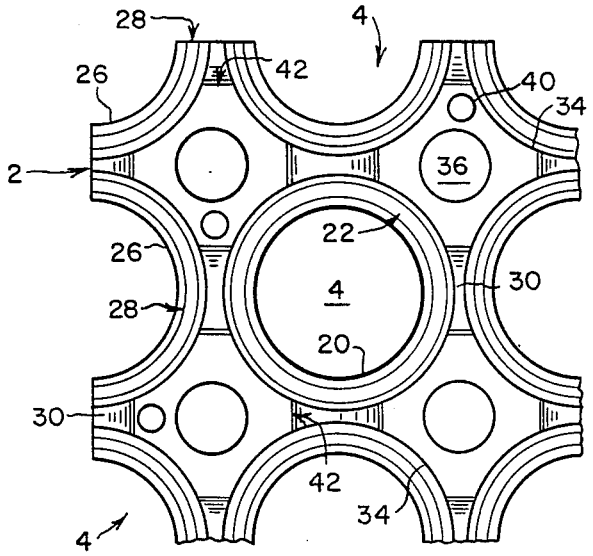
FIG. 2 is an enlarged view of a portion of the spacer tray of FIG. 1.
Figure 3:
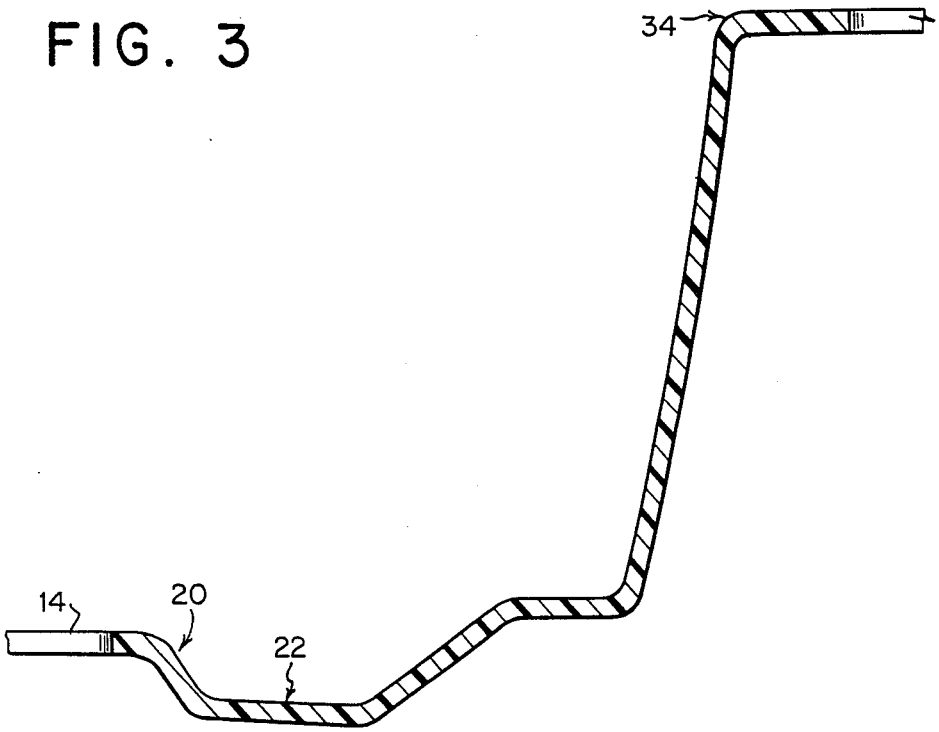
FIG. 3 is a cross-sectional view taken along line 3—3 of FIG. 1.

A generally-circular receptacle central opening 14 passes through each tray-interior can-bottom receptacle 6. A corresponding generally half-circular cut-out 16 is removed from each interior-edge can-bottom receptacle 12, and a corresponding generally quarter-circular cut-out 18 is removed from each corner can-bottom receptacle 10. The receptacle central openings 14 and the cut-outs 16 and 18 reduce the weight of the spacer tray and consequently reduce the cost of materials needed to manufacture the tray. An annular can-support rim 20 surrounds each receptacle central opening 14 and forms the bottom of each tray-interior can-bottom receptacle 6. As shown best in FIGS. 2 and 3, an annular can-base-lip groove 22 is formed in the can support rim 20. As may be seen in FIG. 5, the can-base-lip groove 22 is dimensioned to receive a base lip 24 of a can 32 seated in the can-bottom receptacle 6. The tray-periphery can-bottom receptacles 8 have corresponding can-bottom support rims 26 in which are formed can-base-lip grooves 28, as may be seen in FIG. 2.

Figure 6:
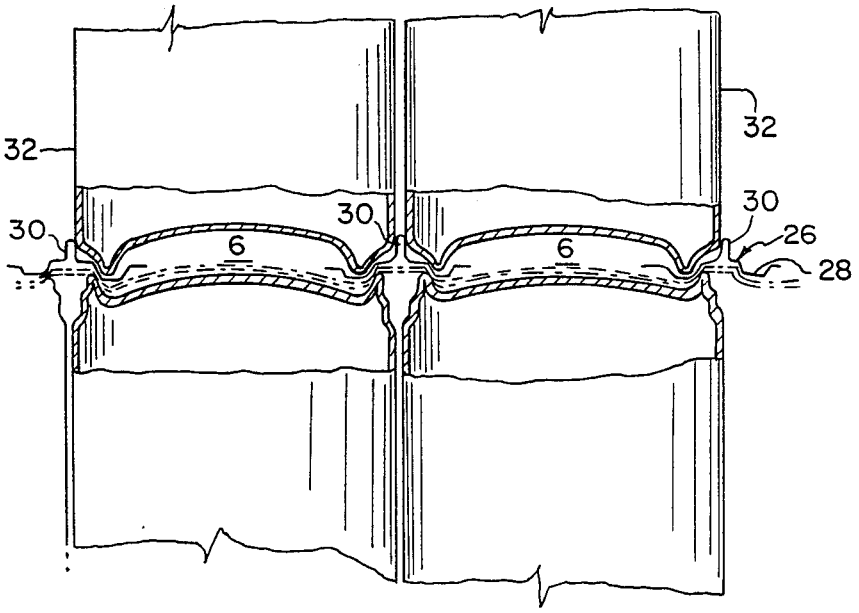
FIG. 6 is a cross-sectional view taken along line 6—6 of FIG. 1 illustrating the spacer tray in use in a shrink-wrapped package in which cans are seated in the spacer tray and the spacer tray is resting on the tops of cans.

Between each pair of adjacent can-bottom receptacles 4 is a can spacer wall 30. As may be seen in FIG. 6, the can spacer walls 30 maintain a separation between bottom portions of cans 32 seated in adjacent can-bottom receptacles 6.

A can-loading guiding structure 34 is located centrally of each group of four can-bottom receptacles 4 defined by the intersection of a pair of adjacent rows of receptacles with a pair of adjacent columns of receptacles. As may be seen in FIG. 7, each canloading guide structure 34 projects above the can-bottom support rims 20 and 26 of the spacer tray 2 when the spacer tray 2 is in a horizontal rest position. Side walls of the can-loading guide structure 34 are shaped to guide the bottom portions of cans into the can-bottom receptacles 4 adjacent to the can-loading guide structure when cans are loaded into the spacer tray 2. A can-loading-guide-pin opening 36 passes centrally through each can-loading guide structure 34. As explained below, the can-loading-guide-pin openings 36 permit a can-loading-guide-pin to pass through the spacer tray 2 for locating the spacer tray during loading and for guiding cans into the can-bottom receptacles 4.

Figure 4:
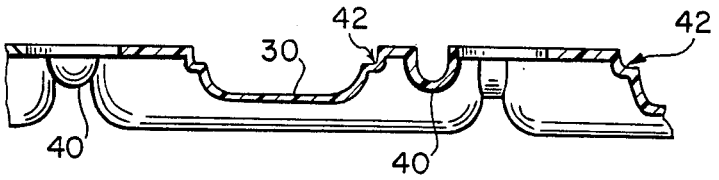
FIG. 4 is a cross-sectional view taken along line 4—4 of FIG. 1.

As shown best in FIG. 4, nesting-binding interference lugs 40 project from the tops of certain of the can-loading guide structures 34 downwardly toward a base plane of the spacer tray 2 when the tray is in a horizontal rest position. The nesting-binding interference lugs 40 are located in the spacer tray such that when a first spacer tray 2 is placed atop a second spacer tray 2 with the can-bottom receptacles 4 of the two trays in alignment with the two spacer trays facing in the same direction, and with one tray rotated 180° relative to the other tray in the plane of the trays, the nesting-binding interference lugs 40 of the upper tray rest upon the can-loading guide structures 34 of the lower tray and prevent the two spacer trays from binding by nesting too tightly one inside the other.

As an example of the functioning of the nesting-binding interference lugs 40, consider a first and a second spacer tray 2 with can-loading guide structures 34*a* and 34*b* identified in FIG. 1. If the first spacer tray is rotated 180. relative to the second spacer tray and placed atop the second spacer tray with the can-bottom receptacles 4 of the two spacer trays substantially aligned and the two spacer trays facing with their can-bottom receptacles 4 opening upwards, the can-loading guide structure 34*a* of the second, lower spacer tray will be substantially aligned with the can-loading guide structure 34*b* of the first, upper spacer tray. However, the nesting-binding interference lug 40*b* on the can-loading guide structure 34*b* on the first, upper spacer tray will not be aligned with the nesting-binding interference lug 40*a* on the can-loading guide structure 34*a* of the second, lower spacer tray. Instead, a lower surface of the interference lug 40*b* of the upper spacer tray will rest against a top surface of the can-loading guide structure 34*a* of the lower spacer tray and will tend to prevent the two spacer trays from nesting together so closely as to bind. The other nesting-binding interference lugs 40 perform in an analagous manner.

Each can-loading guide structure 34 includes four nesting-binding interference notches 42 formed respectively in four sides of the guide structure 34. The nesting-binding interference notches 42 extend downwardly from the top of the can-loading guide structures 34 toward the base plane of the spacer tray 2, as shown in FIG. 4. The essentially vertical inclination of the side walls of the nesting-binding interference notches 42 and the wall thickness of the side walls of the notches tend to prevent vertically aligned nesting-binding interference notches 42 from nesting one inside the other when two spacer trays are placed one atop the other.

Figure 7:
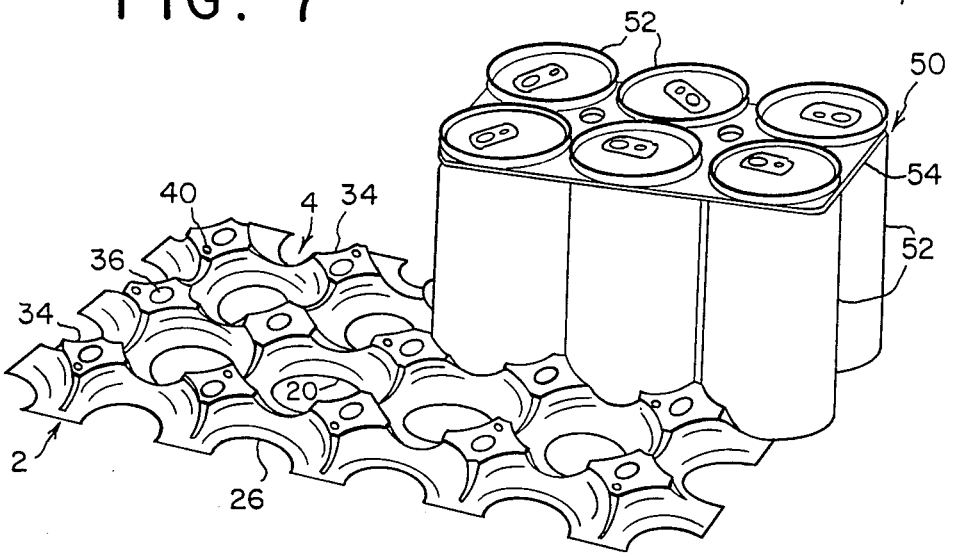
FIG. 7 is a perspective view of the spacer tray of FIG. 1 in which a six pack of cans is seated.
Figure 8:
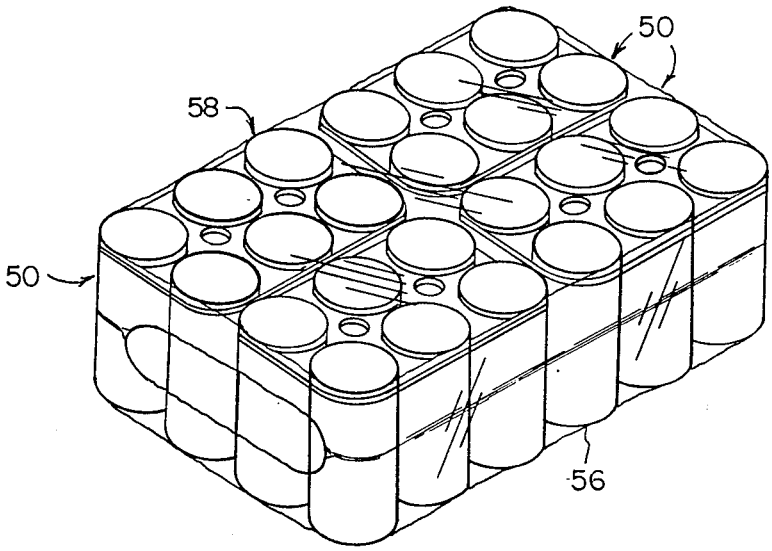
FIG. 8 is a perspective view of a package of four six-packs of cans seated on the spacer tray of FIG. 1 (not shown) and wrapped with a shrink-wrap covering.

As shown in FIG. 7, a six-pack of 50 cans can be seated in six can-bottom receptacles 4 of the spacer tray 2. The cans 52 which are seated in tray-periphery can-bottom receptacles 8 project outwardly beyond the perimeter of the spacer tray 2. The spacer tray 2 maintains the bottom portions of the cans of the six pack 50 spaced apart from one another. The tops of the cans of the six pack 50 are held in a top grip 54 which tends to maintain the tops of the cans in a spaced-apart relationship. As shown in FIG. 8, four six packs 50 may be seated in a spacer tray 2 (not shown) and wrapped with a taut plastic shrink-wrap covering 56 to form a can-transport package 58 of six packs which can be stored and transported as a unit.

Figure 5:
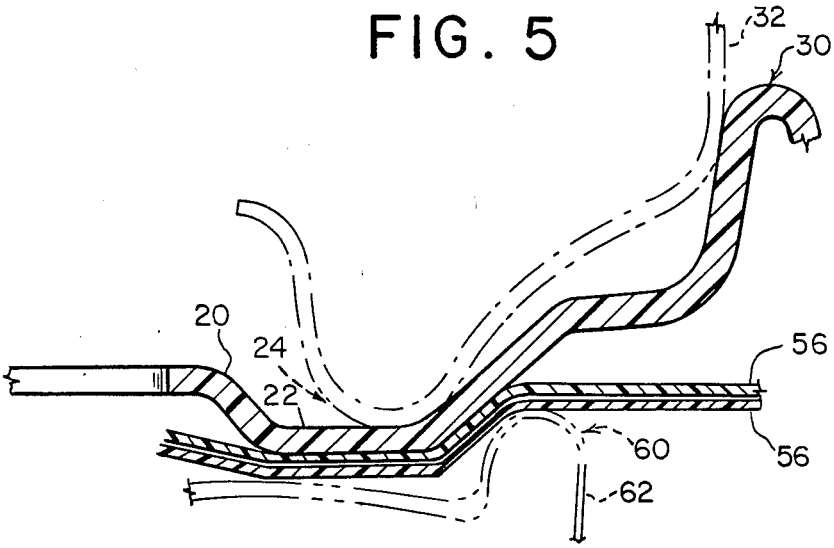
FIG. 5 is a cross-sectional view taken along line 5—5 of FIG. 1 illustrating a detail of the spacer tray in use in a shrink-wrapped package in which the bottom of a first can is seated in the spacer tray and the spacer tray is resting on the top of a second can.

Turning again to FIG. 5, certain commercial beverage cans have an annular base lip 24 and an annular top lip 60 which are shaped and dimensioned so that when the bottom of the first can 32 is placed upon the top of a second can 62, the base lip 24 of the first can fits within the top lip 60 of the second can. The can-base-lip groove 22 in the can-support rim 20 of the can-bottom receptacles 4 of the spacer tray 2 is shaped and dimensioned so that when the spacer tray is placed upon a lower can 62 with the underside of a case-bottom receptacle 4 in alignment with the lower can, the can-base-lip groove 22 fits within the top lip 60 of the lower can. When two can-transport packages 58 of six packs are stacked one atop the other, the shrink-wrap covering 56 of the two packages deforms to enable the undersides of the can-bottom receptacles 4 of the spacer trays of the upper package 58 to fit within the top lips 60 of the cans in the lower package, as shown in FIG. 5. Thus when two can-transport packages 58 of six packs are stacked one atop the other, the packages form an interlocking structure which tends to prevent the packages from sliding relative to one another.

Figure 9:
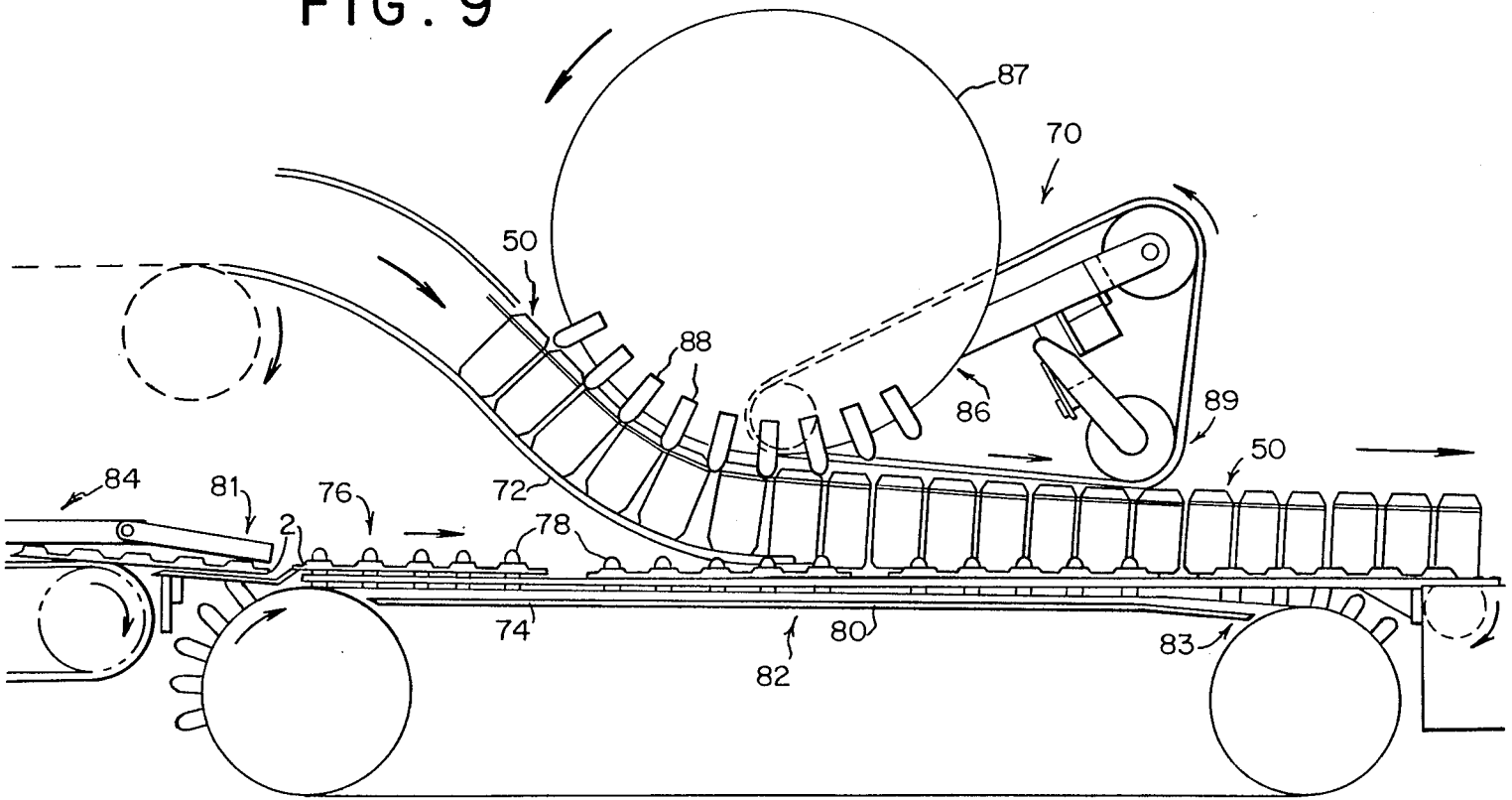
FIG. 9 is a simplified schematic diagram in a side view of a first spacer-tray loading machine for loading preferred spacer trays of the invention with FIG. 10 is a partially-cut-away side view of can-loading guide pin passing through a can-loading-guide-pin opening of a preferred spacer tray of the invention being loaded with cans in the spacer-tray loading machine of FIG. 9.

Turning now to FIG. 9, a spacer-tray loading machine 70 has an arcuate six-pack loading ramp 72 which receives two essentially parallel rows of six packs 50 of cans from a canning line (not shown). For clarity, the row of cans in the plane of the drawing closest to the viewer are not shown, so that elements which extend between the first two rows of cans closest to the viewer are visible. A guide-pin chain loop 74 has guide-pin arrays 76 of can-loading guide pins 78 mounted on it. Each guide-pin array 76 has fifteen can-loading guide pins 78 positioned to align with the fifteen can-loading guide-pin openings 36 in the spacer tray 2. An upper portion of the guide-pin chain loop 74 extends generally horizontally on a chain lop track 80 from a guide-pin insertion station 81, under a can-loading station 82, and to a guide-pin withdrawal station 83. The chain-loop track 80 is inclined downward from horizontal at the guide-pin withdrawal station 83.

A spacer-tray feed line 84 is adapted to feed spacer trays 2 one at a time to the guide-pin chain loop 74. The spacer-tray feed line 84 is adapted to position spacer tray 2 at the guide-pin insertion station 81 in a timed relation with the advancing motion of the guide-pin chain loop 74 so that the motion of the guide-pin chain loop 74 causes the can-loading guide pins 78 of a guide-pin array 76 to be inserted through the can-loading guide-pin openings 36 of the spacer tray. Motion of the guide-pin chain loop 74 withdraws the spacer tray 2 from the spacer-tray feed line 84 and carries it away from the guide-pin insertion station 81 towards the can-loading station 82.

Figure 10:
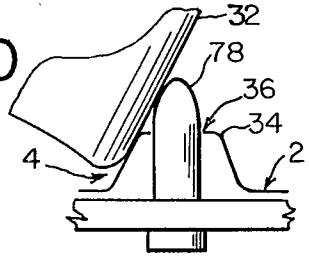

A can positioner 86 is located above the six-pack loading ramp 72. The can positioner 86 includes a rotatable can-positioner wheel 87 from which can-locating pins 88 project radially outwardly. For simplicity, only a portion of the can-locating pins 88 mounted on the can-positioner wheel 87 are shown in FIG. 9. The can-locating pins 88 project between the tops of the cans of the six packs on the loading ramp 72. The curvature of the arcuate loading ramp 72 and the urging of the can-loading pins 88 causes the bottoms of the cans to spread apart from one another as the six packs advance down the loading ramp. The chain loop 74 carries spacer trays 2 to the can-loading station 82 and beneath the loading ramp 72. The rotation of the can-positioner wheel 87 and thus the advancement of the six packs 50 down the six-pack loading ramp 72 is synchronized with the motion of a spacer tray through the can-loading station 82. The can-loading guide pins 78 of each guide-pin array 76 project through the can-loading-guide-pin openings 36 of the spacer tray 2 as it is carried through the can-loading station 82. As shown in FIG. 10, the can-loading guide pins 78 contact cans 32 passing from the six-pack loading ramp and assist in guiding the bottoms of the cans into the can-bottom receptacles 4 of the spacer tray 2.

The guide-pin chain loop 74 carries the spacer trays 2 thus loaded with six packs under a can-seating apparatus 89 which presses the cans firmly down into the can-bottom receptacles 4 of the spacer tray 2.

The loaded spacer trays 2 are then carried by the guide-pin chain loop 74 to the guide-pin withdrawal station 83 where the guide pins 78 of the guide-pin array 76 are withdrawn from the spacer tray 2. The spacer tray loaded with four six-packs 50 is then introduced into a shrink-wrap film wrapping machine (not shown) for wrapping with a shrink-wrap material to form a can-transport package.

Figure 11:
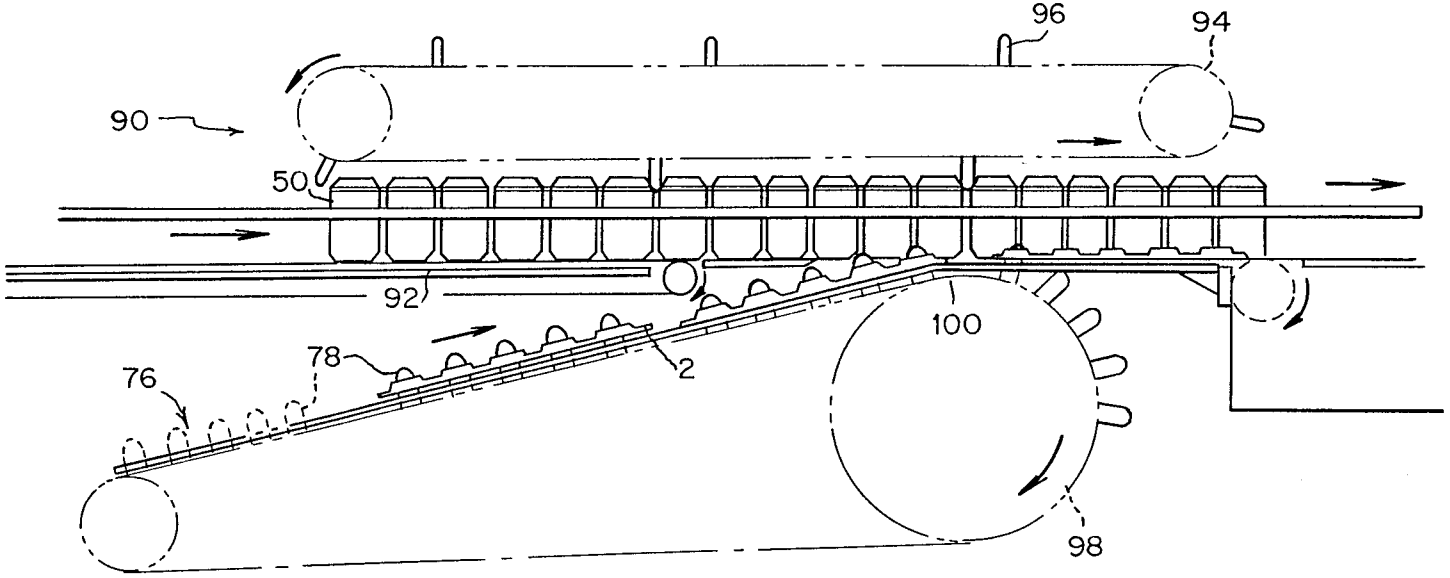
FIG. 11 is a simplified schematic diagram in a side view of a second spacer-tray loading machine for loading preferred spacer trays of the invention with cans.

FIG. 11 illustrates a second spacer-tray loading machine 90 in which spacer trays 2 are introduced from below into a line carrying six packs of cans. The loading machine 90 includes a generally horizontal six-pack loading track 92 which receives six packs 50 of cans from a canning line (not shown). The six packs on the six-pack loading track 92 are arranged in two essentially-parallel rows. As was done in FIG. 9, the row of cans in the plane of the drawing closest to the viewer is not shown in FIG. 11 so that elements which extend between the first and second rows of cans closest to the viewer are visible. An upper six-pack separator chain 94 includes separator pins 96 which engage the tops of alternate six packs to maintain a spacing between pairs of six packs passing through the loading machine 90 along the track 92. A loading-pin chain loop 98 is located below the six-pack loading track 92. The loading-pin chain loop 98 includes guide-pin arrays 76 of fifteen can-loading guide pins 78. The guide pins 78 are arranged in a three-row by five-column array corresponding to the fifteen can-loading-guide-pin openings 36 of the spacer tray 2.

The loading machine 90 includes a spacer-tray feed mechanism (not shown) for loading the spacer trays on the chain loop 98 with the guide pins 78 projecting through the can-loading guide-pin openings 36. An upper section of the chain loop 98 is inclined upwardly in the direction of chain motion and extends to just below the six-pack loading track 92. A spacer-tray-insertion opening 100 is dimensioned to permit spacer trays 2 on the loading chain 98 to approach six packs on the loading track 92 from the underside. The motion of the six-pack separator chain 94 and the guide-pin chain loop 98 is synchronized so that the cans of four six-packs are positioned to seat within the twenty-four can-bottom receptacles 4 of the spacer tray. The can-loading guide pins 78 assist in guiding the bottoms of the cans into the can-bottom receptacles 4 as the spacer tray 2 passes through the spacer-tray insertion opening 100. The six packs 50 thus loaded on the spacer tray 2 move from the spacer-tray loading machine 90 to a shrink-wrap film wrapping machine (not shown) to form can-transport packages.

Figure 12:
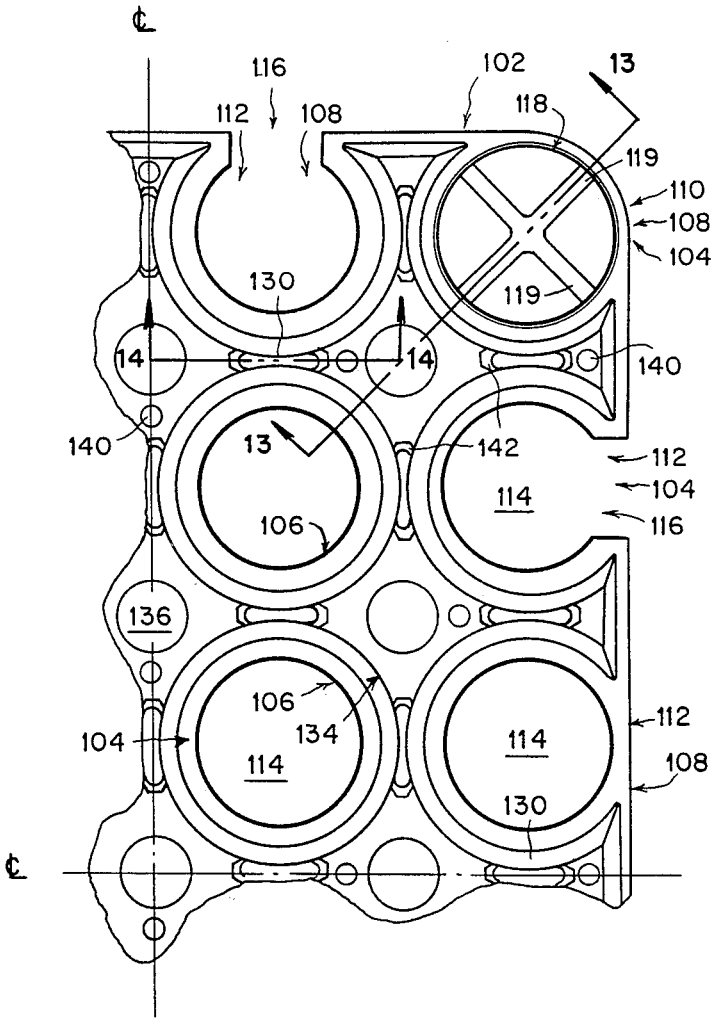
FIG. 12 is a top view of a portion of a spacer tray of the invention particularly preferred for accommodating loose cans.

Turning now to FIG. 12, a spacer tray 102 is shaped to form twenty-four can-bottom receptacles 104. For clarity, only six of the can-bottom receptacles 104 are shown in FIG. 12. The can-bottom receptacles 104 are arranged in four essentially parallel columns and six essentially parallel rows with the distance between adjacent rows substantially equal to the distance between adjacent columns. Eight tray-interior can-bottom receptacles 106, sixteen tray-periphery can-bottom receptacles 108, four corner can-bottom receptacles 110 and twelve interior-edge can-bottom receptacles 112 are defined analogously to corresponding can-bottom receptacles of the spacer tray 2 of FIG. 1 discussed above.

Each can-bottom receptacle 104 is shaped to receive at least a part of the bottom portion of a can. Each tray interior can-bottom receptacle 106 is shaped to receive and substantially completely surround the bottom portion of a can. Each interior-edge can-bottom receptacle 112 is shaped to receive and surround roughly three quarters of the circumference of the bottom portion of a can. Each tray-interior can-bottom receptacle 106 and interior-edge can-bottom receptacle 112 tends to locate and hold cans seated in the receptacle in position laterally. Each corner can-bottom receptacle 110 is shaped to receive and surround just over one half of the circumference of a bottom portion of a can.

A generally circular receptacle central opening 114 passes through each tray-interior can-bottom receptacle 106 and through each interior-edge can-bottom receptacle 112. A loader-finger opening 116 passes from the outer perimeter of the spacer tray 102 to the receptacle central opening 114 of each of the eight interior-edge can-bottom receptacles 112 which are located adjacent to the four corner can-bottom receptacles 110. The loader-finger openings 116 permit tray-loader fingers (not shown) from a high-speed spacer-tray loading machine to pass laterally from outside of the perimeter of the spacer tray 102 to within the receptacle central openings 114 of the interior-edge can-bottom receptacles 112 located adjacent the corner can-bottom receptacles 110 for handling the spacer trays during loading. The spacer tray 102 can therefore be loaded by a spacer-tray loading machine which can also load the spacer tray 2 discussed above in connection with FIG. 1.

Located centrally within each corner can-bottom receptacle 110 is a can-bottom locator boss 118. As shown best in FIG. 12, the can-bottom locator boss 118 is shaped to fit within a concave indentation 121 in the bottom of a can 123. The can-bottom locator boss 118 tends to locate and hold in position laterally the bottom of a can seated in the corner can-bottom receptacle 110. Cans seated in the corner can-bottom receptacles 110 are securely located and held in position laterally even though the receptacle generally surrounds only just over half of the circumference of the bottom portion of the can. A pair of cross-shaped grooves 119 are formed in the can-bottom locator boss 118 to reinforce the boss.

Figure 14:
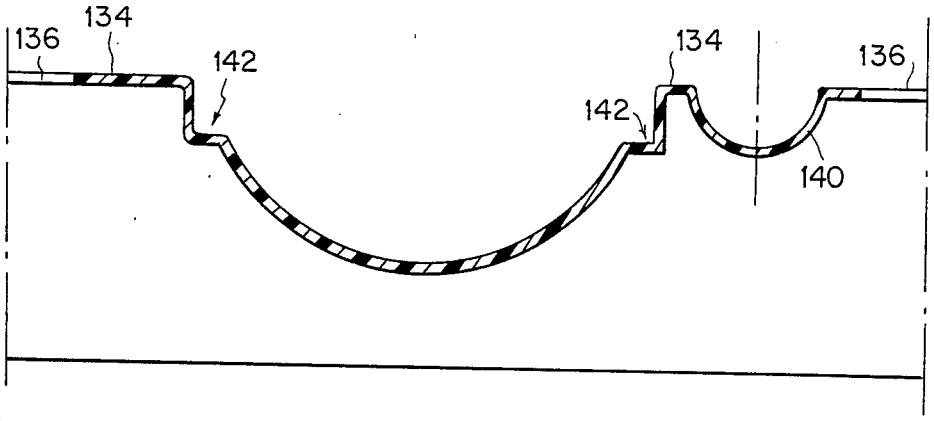
FIG. 14 is a cross-section view taken along line 14—14 of FIG. 12.

As shown in FIGS. 12 and 14, the spacer tray 102 includes can-loading guide structures 134 located centrally of each group of four can-bottom receptacles 104, can-loading guide-pin openings 136 passing centrally through each can-loading guide structure 134, nesting-binding interference lugs 140 projecting downwardly from the tops of certain of the can-loading guide structures 134 and nesting-binding interference notches 142 formed in the sides of the guide structures 134. A can spacer wall 130 extends between each pair of adjacent can-bottom receptacles 104. The can-loading guide structures 134, the can-loading guide-pin openings 136, the nesting-binding interference lugs 140, the nesting-binding interference notches 142 and the can spacer walls 130 function analogously to the corresponding elements of the spacer tray 2 discussed above in connection with FIG. 1 and consequently, for conciseness, will not be discussed further here.

Figure 13:
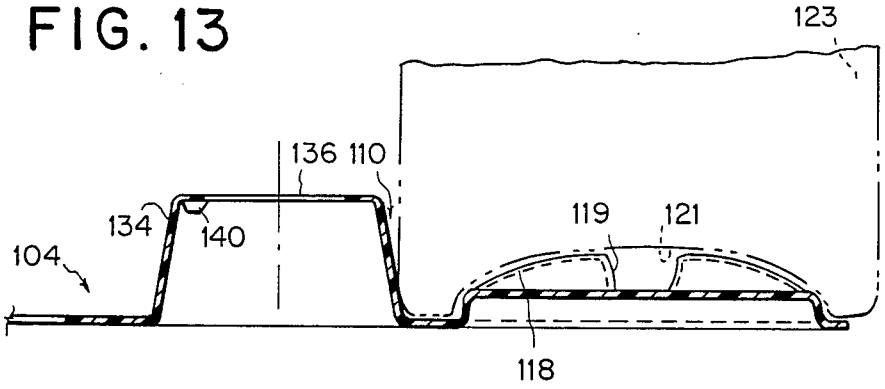
FIG. 13 is a cross-sectional view taken along the line 13—13 of FIG. 12.

The spacer tray 102 of FIGS. 12 through 14, is particularly adapted for packaging loose cans; i.e., cans not connected by top grips into multipacks. The spacer tray 102 tends to locate and hold in position laterally cans seated in the corner can-bottom receptacles 104, the interior-edge can-bottom receptacles 108, and the tray-interior can-bottom receptacles 106 to maintain a spacing between adjacent cans in a shrink-wrapped package even when the tops of the cans are not positioned with top grips.

It is not intended to limit the present invention to the specific embodiments described above. For example, spacer trays of the invention may have twelve container-bottom receptacles arranged in three rows and four columns. Other numbers and arrangements of container-bottom receptacles may be used if desired. Each of the container-bottom receptacles of the spacer tray—including the tray periphery container-bottom receptacles—can substantially surround the bottoms of containers. The spacer tray may include no container- loading-guide-pin openings or one, two, four or other number of container-loading-guide-pin openings. Drainage channels can be formed in side and bottom walls of the container-bottom receptacles to permit condensation on containers seated in the receptacles to drain through openings or cutouts in the bottoms of the receptacles. The quarter-circular cut-outs in the corner can-bottom receptacles may be partially or wholly filled in, as may be the half-circular cut-outs in the interior-edge can-bottom receptacles or the receptacle central openings in the tray-interior can-bottom receptacles. Separator bars may be mounted crosswise on the six-pack separator chain of the second spacer-tray loading machine to maintain a spacing between six packs. It is recognized that these and other changes may be made in the spacer tray specifically described herein without departing from the scope and teaching with the instant invention and it is intended to encompass all other embodiments, alterations and modifications consistent with the invention.

I claim:

1. A spacer tray or containers, the spacer tray being formed of a plastic sheet material, the spacer tray being shaped to provide a number of container-bottom receptacles equal to ($m \times n$), where m is an integer greater than 2 and n is an integer greater than 2, the container-bottom receptacles being disposed in an array of m columns and n rows, a number of container-bottom receptacles equal to (m−2) (n−2) being located interior of container-bottom receptacles located on the perimeter of the spacer tray to define tray-interior container-bottom receptacles, each container-bottom receptacle being shaped to receive at least a part of a bottom portion of a container, each tray-interior container-bottom receptacle being configured to surround substantially entirely the bottom portion of a container seated in the receptacle, a container-spacer wall being located between each pair of adjacent container-bottom receptacles to maintain the bottom portions of containers seated in the pair of adjacent container-bottom receptacles in a spaced-apart relationship, the spacer tray having a height less than half the height of the containers the spacer tray is adapted to seat, the spacer tray being shaped so that two such spacer trays facing in the same direction and placed one atop the other with the container-bottom receptacles of the two spacer trays generally coaxially aligned nest one inside the other container-bottom receptacle within container-bottom receptacle, the spacer tray having a plurality of nesting-binding interference structures shaped and positioned to prevent two spacer trays so nested one inside the other from binding at least when one spacer tray has a predetermined nesting- binding-interference orientation relative to the other in the plane of the spacer trays.

2. The spacer tray according to claim 1 further including a plurality of container-loading guide structures, each container-loading guide structure being located centrally of a group of four container-bottom receptacles defined by the intersection of a pair of adjacent rows of receptacles with a pair of adjacent columns of receptacles, each container-loading guide structure having side walls shaped to guide bottom portions of containers into container-bottom receptacles adjacent to the container-loading guide structure, the nesting-binding interference structures being located on the container-loading guide structures.

3. The spacer tray according to claim 2 in which the nesting-binding interference structures include nesting-binding interference lugs, each nesting-binding interference lug being located in a top portion of a container-loading guide structure, the nesting-binding interference lug projecting from the top portion of the container-loading guide structure toward a base plane of the spacer tray inside a hollow interior of the container-loading guide structure, the nesting-binding interference lugs being located such that when two spacer trays facing in the same direction and placed on top of the other with the container-bottom receptacles generally coaxially aligned and with one spacer tray rotated substantially 180 degrees relative to the other in the plane of the spacer trays, the nesting-binding interference lugs of the upper tray rest against top surfaces of container-loading guide structures of the lower tray to interfere with nesting of the two trays.

4. The spacer tray according to claim 2 in which the nesting-binding interference structures include nesting-binding interference notches, each nesting-binding interference notch being located in a side wall in a top portion of a container-loading guide structure, the nesting-binding interference notch projecting from the top portion of the container-loading guide structure toward a base plane of the spacer tray inside a hollow interior of the container-loading guide structure, the nesting-binding interference notches being shaped such that when two spacer trays facing in the same direction and placed one on top of the other with the container-bottom receptacles generally coaxially aligned the nesting-binding interference notches of the upper tray interferingly contact nesting-binding interference notches of the lower tray to interfere with the nesting of the two trays.

5. A spacer tray for containers, the spacer tray being formed of a plastic sheet material, the spacer tray being shaped to provide a number of container-bottom receptacles equal to (m×n), where m is an integer greater than 2 and n is an integer greater than 2, the container-bottom receptacles being disposed in an array of m columns and n rows, a number of container-bottom receptacles equal to (m−2) (n−2) being located interior of container bottom receptacles located on the perimeter of the spacer tray to define tray-interior container-bottom receptacles, each container-bottom receptacle being shaped to receive at least a part of a bottom portion of a container, each tray-interior container-bottom receptacle being configured to surround substantially entirely the bottom portion of a container seated in the receptacle, a container-spacer wall being located between each pair of adjacent container-bottom receptacles to maintain the bottom portions of containers seated in the pair of adjacent container-bottom receptacles in a spaced-apart relationship, the spacer tray having a height less than half the height of the containers the spacer tray is adapted to seat, the spacer tray being shaped so that two such spacer trays facing in the same direction and placed one atop the other with the container-bottom receptacles of the two spacer trays generally coaxially aligned nest one inside the other container-bottom receptacle within container-bottom receptacle, the spacer tray having a number of container-loading-guide-pin openings passing through it, each container-loading-guide-pin opening being shaped, dimensioned, and located to permit a container-loading-guide pin to pass through the opening for locating the spacer tray during loading.

6. The spacer tray according to claim 5 in which each container-loading-guide-pin opening is located centrally of four container-bottom receptacles defined by the intersection of a pair of adjacent rows of receptacles with a pair of adjacent columns of receptacles, each container-loading-guide-pin opening being shaped to permit a container-loading-guide pin to pass through the opening for locating the spacer tray and guiding bottom portions of containers into container-bottom receptacles during loading of the spacer tray.

7. The spacer tray according to claim 6 further including a plurality of container-loading guide structures, each container-loading guide structure being located centrally of four container-bottom receptacles surrounding a container-loading-guide-pin opening, the container-loading-guide-pin opening passing centrally through the container-loading guide structure, each container-loading guide structures having side walls shaped to guide bottom portions of containers into container-bottom receptacles adjacent to the container-loading guide structure.

8. A spacer tray for containers, the spacer tray being formed o a plastic sheet material, the spacer tray being shaped to provide a number of container-bottom receptacles equal to (m×n), where m is an integer greater than 2 and n is an integer greater than 2 , the container-bottom receptacles being disposed in an array of am columns and n rows, each container-bottom receptacle being shaped to receive at least a part of a bottom portion of a container, a number of container-bottom receptacles equal to 2(m+n)−4 being located on the perimeter of the spacer tray to define tray-periphery container-bottom receptacles, a number of container-bottom receptacles equal to (m−2) (n−2) being located interior of the tray-periphery container-bottom receptacles to define tray-interior container-bottom receptacles, each tray-interior container-bottom receptacle being configured to surround substantially entirely the bottom portion of a container seated in the receptacle, each tray-periphery container-bottom receptacle being configured to surround only partially the bottom portion of a container seated in the receptacle so that a portion of the container extends outwardly of the perimeter of the spacer tray, the spacer tray being dimensioned so that the outer perimeter of the spacer tray extends n further laterally than the outer edges of containers seated in the tray-periphery container-bottom receptacles, the spacer tray having a height less than half the height of the containers the spacer tray is adapted to seat, a container-spacer wall being located between each pair of adjacent container-bottom receptacles to maintain the bottom portions of containers seated in the pair of adjacent container-bottom receptacles in a spaced-apart relationship.

9. The spacer tray according to claim 8 in which each tray-interior container-bottom receptacle has an annular can-base-lip groove formed in it and each tray-periphery container-bottom receptacle has at least a length of an annular can-base-lip groove formed in it, each can-base-lip groove being shaped and dimensioned to receive an annular can-base-lip of a can seated in the container-bottom receptacle in which the can-base-lip groove is formed.

10. The spacer tray according to claim 9 in which each can-base-lip groove is shaped and dimensioned to fit within an annular can top lip of a can upon which is placed the underside of the container-bottom receptacle in which the can-base-lip groove is formed.

11. The spacer tray according to claim 8 in which each tray-interior container-bottom receptacle has a generally-circular receptacle central opening passing through it and each tray-periphery container-bottom receptacle has a generally partial-circular receptacle cutout removed from it, the receptacle cutout extending to a perimeter of the spacer tray.

12. A spacer tray for containers, the spacer tray being formed of a plastic sheet material, the spacer tray being shaped to provide at least four container-bottom receptacles, the container-bottom receptacles being disposed in a row-column array, each container-bottom receptacle being shaped to receive at least a part of a bottom portion of a container, a container-spacer wall being located between each pair of adjacent container-bottom receptacles to maintain the bottom portions of containers seated in the pair of adjacent container-bottom receptacles in a space-apart relationship, the spacer tray having a height less than half the height of the containers the spacer tray is adapted to seat, at least four of the container-bottom receptacles having container-bottom locators positioned centrally within the receptacles, each of the container-bottom locators being shaped to fit within an indentation in the bottom of a container seated in the receptacle to tend to locate the bottom of the container, each of the four container-bottom receptacles disposed at a corner of the spacer tray having a container-bottom locator positioned within the receptacle, each container-bottom receptacle disposed at a corner of the spacer tray being configured to surround only partially the radially-outer walls of a bottom portion of a container seated in the receptacle, outer perimeters of the spacer tray at the corners not extending laterally further than the outer edges of containers seated in the four container-bottom receptacles disposed at the corners of the spacer tray.

13. The spacer tray according to claim 12 in which each container-bottom locator is a generally dome-shaped boss.

14. The spacer tray according to claim 13 in which the dome-shaped boss of each container-bottom locator has a plurality of grooves formed in it for reinforcing the boss.

15. The spacer tray according to claim 12 in which only the container-bottom receptacles disposed at the four corners of the spacer tray have a container-bottom locator positioned within the receptacle.

16. A spacer tray for containers, the spacer tray being formed of a plastic sheet material, the spacer tray being shaped to provide a number of container-bottom receptacles equal to (m×n), where m is an integer greater than 2 and n is an integer greater than 2, the container-bottom receptacles being disposed in an array of m columns and n rows, each container-bottom receptacle being shaped to receive at least a part of a bottom portion of a container, a number of container-bottom receptacles equal to 2(m+n)−4 being located on the perimeter of the spacer tray to define tray-periphery container-bottom receptacles, a number of container-bottom receptacles equal to (m−2) (n−2) being located interior of the tray-periphery container-bottom receptacles to define tray-interior container-bottom receptacles, each tray-interior container-bottom receptacles, each tray-interior container-bottom receptacle being configured to surround substantially entirely the bottom portion of a container seated in the receptacle, each tray-periphery container-bottom receptacle being configured to surround only partially the bottom portion of a container seated in the receptacle so that a portion of the container extends outwardly of the perimeter of the spacer tray, a container-spacer wall being located between each pair of adjacent container-bottom receptacles to maintain the bottom portions of containers seated in the pair of adjacent container-receptacles in a spaced-apart relationship, the spacer tray being dimensioned so that the outer perimeter of the spacer tray extends no further laterally than the outer edges of containers seated in the tray-periphery container-bottom receptacles, the spacer tray having a height less than half the height of the containers the spacer tray is adapted to seat, the spacer tray having a number of container-loading-guide-pin openings passing through it equal to (m−1) (n−1), each container-loading-guide-pin opening being located centrally of four container-bottom receptacles defined by the intersection of a pair of adjacent rows of receptacles with a pair of adjacent columns of receptacles, each container-loading guide pin opening being shaped and dimensioned to permit a container-loading guide pin to pass through for locating the spacer tray and guiding bottom portions of containers into container-bottom receptacles during loading of the spacer tray, the spacer tray being shaped so that two such spacer trays facing in the same direction and placed one atop the other with the container-bottom receptacles of the two spacer trays generally coaxially aligned nest one inside the other container-bottom receptacle within container-bottom receptacle, the spacer tray having a plurality of nesting-binding interference structures shaped and positioned to prevent two spacer trays so nested one inside the other from binding at least when one spacer tray has a predetermined nesting-binding-interference orientation relative to the other in the plane of the spacer trays.

17. A container-transport package comprising:

(a) the spacer tray of claim 1;

(b) a plurality of containers, each container having a bottom portion seated in a container-bottom receptacle of the spacer tray; and (c) a shrink-wrap covering generally surrounding the spacer tray and the containers.

18. A container-transport package comprising:

(a) the spacer tray of claim 11;

(b) a plurality of cans, each can having an annular can-base-lip and an annular can-top-lip, each can having a bottom portion seated in a container-bottom receptacle of the spacer tray with the can-base-lip of the can in the can-base-lip groove of the receptacle; and (c) a shrink-wrap covering generally surrounding the spacer tray and the cans.

* * * * *